US008807044B2

(12) United States Patent
Liggett et al.

(10) Patent No.: US 8,807,044 B2
(45) Date of Patent: Aug. 19, 2014

(54) PUCK KEY TRANSITION SYSTEM

(76) Inventors: James Liggett, Martin, MI (US); Troy Lee Garland, Martin, MI (US); Timothy Powers, Martin, MI (US)

( * ) Notice: Subject to any disclaimer, the term of this patent is extended or adjusted under 35 U.S.C. 154(b) by 149 days.

(21) Appl. No.: 13/234,138

(22) Filed: Sep. 15, 2011

(65) Prior Publication Data

US 2012/0067246 A1 Mar. 22, 2012

Related U.S. Application Data

(60) Provisional application No. 61/383,306, filed on Sep. 15, 2010.

(51) Int. Cl.
*B61B 7/00* (2006.01)
*E01B 25/16* (2006.01)

(52) U.S. Cl.
USPC ..... 104/94; 104/91; 104/113; 105/155

(58) Field of Classification Search
USPC ..... 104/89, 91, 94, 107, 115, 121, 112, 104/113; 105/146, 147, 155
See application file for complete search history.

(56) References Cited

U.S. PATENT DOCUMENTS

| | | | | |
|---|---|---|---|---|
| 1,920,774 | A * | 8/1933 | Webb | 105/155 |
| 3,577,930 | A * | 5/1971 | Rooklyn | 104/173.1 |
| 3,961,751 | A * | 6/1976 | Kessler | 238/10 R |
| 4,464,997 | A * | 8/1984 | Dehne | 104/172.4 |
| 4,752,987 | A * | 6/1988 | Dreyer et al. | 16/102 |
| 4,845,806 | A * | 7/1989 | Hamacher | 16/88 |
| 6,640,727 | B2 * | 11/2003 | Ostrobrod | 104/91 |
| 6,810,818 | B2 * | 11/2004 | Petzl et al. | 105/150 |
| 7,392,747 | B2 * | 7/2008 | Ksyk | 104/96 |
| 7,416,054 | B2 * | 8/2008 | Liggett | 182/36 |
| 7,453,358 | B2 * | 11/2008 | Webster | 340/568.5 |
| 8,066,578 | B2 * | 11/2011 | Liggett | 472/136 |
| 8,393,277 | B2 * | 3/2013 | Johnston et al. | 105/30 |
| 2011/0239895 | A1 * | 10/2011 | Liggett | 104/113 |

* cited by examiner

*Primary Examiner* — Zachary Kuhfuss

(57) ABSTRACT

An apparatus and system whereby a first member can move along a cable track and then on a glide track to then move in another direction and back on a glide track. The first member has a secondary retention system disposed therein.

7 Claims, 5 Drawing Sheets

PUCK KEY TRANSITION SYSTEM

PRIORITY CLAIM

This patent application claims priority from provisional patent application number 61/383,306, filed on 15 Sep. 2010, titled PUCK KEY TRANSITION SYSTEM.

FIELD OF THE INVENTION

The invention relates to a system to allow users of a challenge course to remain secured to a single safety member when moving from one challenge element/obstacle to another, or from one direction to another, and also provides for a secondary fall arrest prevention system.

BACKGROUND OF THE INVENTION

Challenge courses are structures that allow a person, or a team to challenge themselves by participating in various events such as walking at elevated heights or climbing. These courses are also used to train military personnel. These courses are also used at recreational parks or other such centers that have go-carts and miniature gulf. It is common for people to wait in line to participate in the challenge course. Therefore increasing the speed of the flow of participants is an important feature of the challenge courses as well as increasing safety. The participants are usually performing some act at an elevated level between support structures. A harness cable secures the participant to a safety hook also called a moveable member. The safety hook or moveable member usually slides along cables substantially oriented horizontally as the participant walks on an "element" or "obstacle" below, whereby the participant is secured to the first member, which may be referred to in this document as a moveable member or safety hook by a cable or cable track. Therefore it is also an important feature to retain the harness cable to the moveable member without interruption.

Many problems with challenge courses involve the traffic flow and the detachment of the harness cable from the moveable member when the participant who is secured to the harness cable, is not secured to the moveable member, the participant can fall to the ground. When the participant walks along the element or obstacle between the support structures, the participant is secured to the harness cable, which is in turn secured to the safety hook, which moves along the safety cables, which may be oriented horizontally. The cause of many of the flow problems are caused by factors such as releasing and re-attaching; or disconnecting and reconnecting of the harness cable from the moveable member or first member that takes place when the participant changes elements, usually at the support structure. For example, when the participant is completing one element, they may stand on a fixed platform at the support structure. Here, the participant, if wishing to travel on another element or obstacle, will remove the safety hook that is specific for that first element, and will attach a second hook, which is specific for the new element.

The present invention solves the problems of removing and re-attaching the first members 30 from the participant. Typically the first member 30 is attached to a human participant via a safety cable, (not illustrated) moveable members or safety hooks. This increases flow speed and safety. Flow speed is increased because the participant's harness hook need not be released and re-attached. Safety is increased because the participant's harness hook remains attached to the moveable member continuously rather than intermittently.

There exists a need to reduce the danger, i.e. falling, created when disconnecting the first member from the participant.

There also exists a need to reduce the time to detach and re-attach the first member, also referred to herein as a moveable members or safety hooks as the participants walk through the different elements or obstacles.

There is also a need to provide for a second fall arrest prevention system, in case the second member fractures or fails.

Multiple embodiments of the system are disclosed herein. It will be understood that other objects and purposes of the invention, and variations thereof, will be apparent upon reading the following specification and inspecting the accompanying drawings.

SUMMARY OF THE INVENTION

One aspect of the present invention is a puck-key transition system (10), comprising: a transition box (20) having a housing (220) capable of having a first member (30) move there through, said housing (220) having a bottom plate (190) extending inwardly there from to a tube glide (150);a cable track (40) disposed through said tube glide (150); a glide track (140) extending inwardly from said housing (220) upwardly from said tube glide (150); and whereby said first member (30) has a glide (120) that is in moveable contact with at least one of said tube glide (150) or said cable track (140), and said first member (30) has at least one of either a puck (80) or a washer (90) disposed upwardly from said glide (120), and at least one of either said puck (80) or said washer (90) is in moveable contact with said glide track (140).

Another aspect of the present invention is a puck-key transition system (10), comprising: a transition box (20) having a housing (220) capable of having a first member (30) move there through, said housing (220) having a bottom plate (190) extending inwardly there from to a tube glide (150); a cable track (40) disposed through said tube glide (150); a glide track (140) extending inwardly from the housing (220) upwardly from said tube glide (150); whereby said first member (30) has a glide (120) that is in moveable contact with at least one of said tube glide (150) or said cable track (140), and said first member (30) has at least one of either a puck (80) or a washer (90) disposed upwardly from said glide (120), and at least one of either said puck (80) or said washer (90) is in moveable contact with said glide track (140); a first member opening (160) defined by the space between two of said adjacent track glides (140); said first member (30) having a second member (70) that extends downwardly from at least one of either said puck (80) or said washer (90); said first member (30) having two arms (200) on both sides of said first member (30), a distance between said arms (200) define a first member opening (60) on each side of said first member (30), whereby the first member (30) can be moved along a cable track (40) and the opening (60) can receive said bottom plate (190) as the first member (30) moves through the transition box (20); a secondary retention system (270) connected at one end to a top nut (100), and at a bottom end to another part of the first member (30), said secondary retention system (270) disposed through a secondary member (70); a non-metallic bumper (210) disposed on an arm (200) of the first member (30), said non-metallic bumper (210) extending slightly outwardly from said arm (200), so that as the first member (30) is moving through said transition box (20), said non-metallic bumper (210) can contact the transition box (20) to prevent the arm (200) from contacting the transition box (20); a tube glide opening (250) defined by two opposed tube glides (150); a clacker gate (260) that is hingedly connected to said transition box (20) and swings open in one direction so that the first member (30) can move through the clacker gate (260) in only one direction (50); and a radio frequency identification device (180) secured to said first member (30); said first member (30) has a width of first member (240) that is about the same as the width of the transition box (20) and a front-to-rear distance (230) so that the first member (30) cannot be removed from the glide tube (150) and fall downwardly from the transition box (20).

These and other features, aspects and advantages of the present invention will become better understood with reference to the following drawings, description and claims.

DETAILED DESCRIPTION

Reference Numerals

Figure 1:
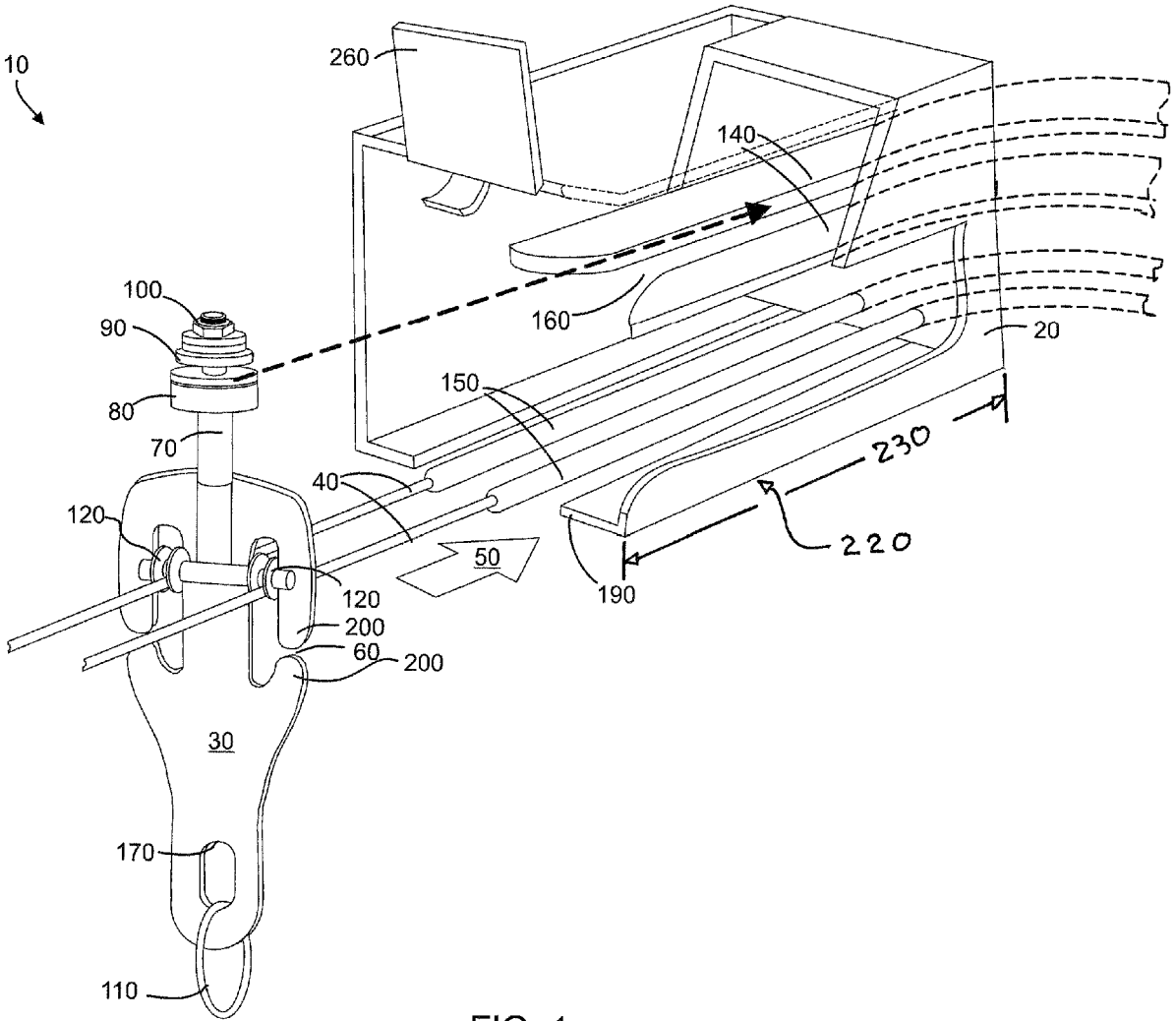
FIG. 1 is a pictorial view of one embodiment of the present invention.

10 puck first member transition system
20 transition box or cage
30 first member
40 cable track
50 direction of first member
60 first member opening
70 second member
80 puck
90 washer
100 top nut
110 shackle to harness
120 pulley or glide
130 one-way flap
140 glide track
150 tube glide
160 glide track opening
170 harness connection means
180 radio frequency identification ("RFID")
190 bottom plate
200 arm
210 non-metallic bumper
220 housing
230 front-to-rear distance
240 width of first member
250 tube glide opening
260 clacker gate
270 secondary retention system Referring to FIG. 1, a puck-first member transition system ("the system") 10 is illustrated. The system 10 may include a first member 30 that is capable of traversing a cable track 40 and a glide track 140. The cable track 40 may be disposed over an element or obstacle (not illustrated). The cable track 40 may have at least one end connected to a transition box or cage 20. The cable track 40 may be comprised of two separate cables 40.

Figure 3:
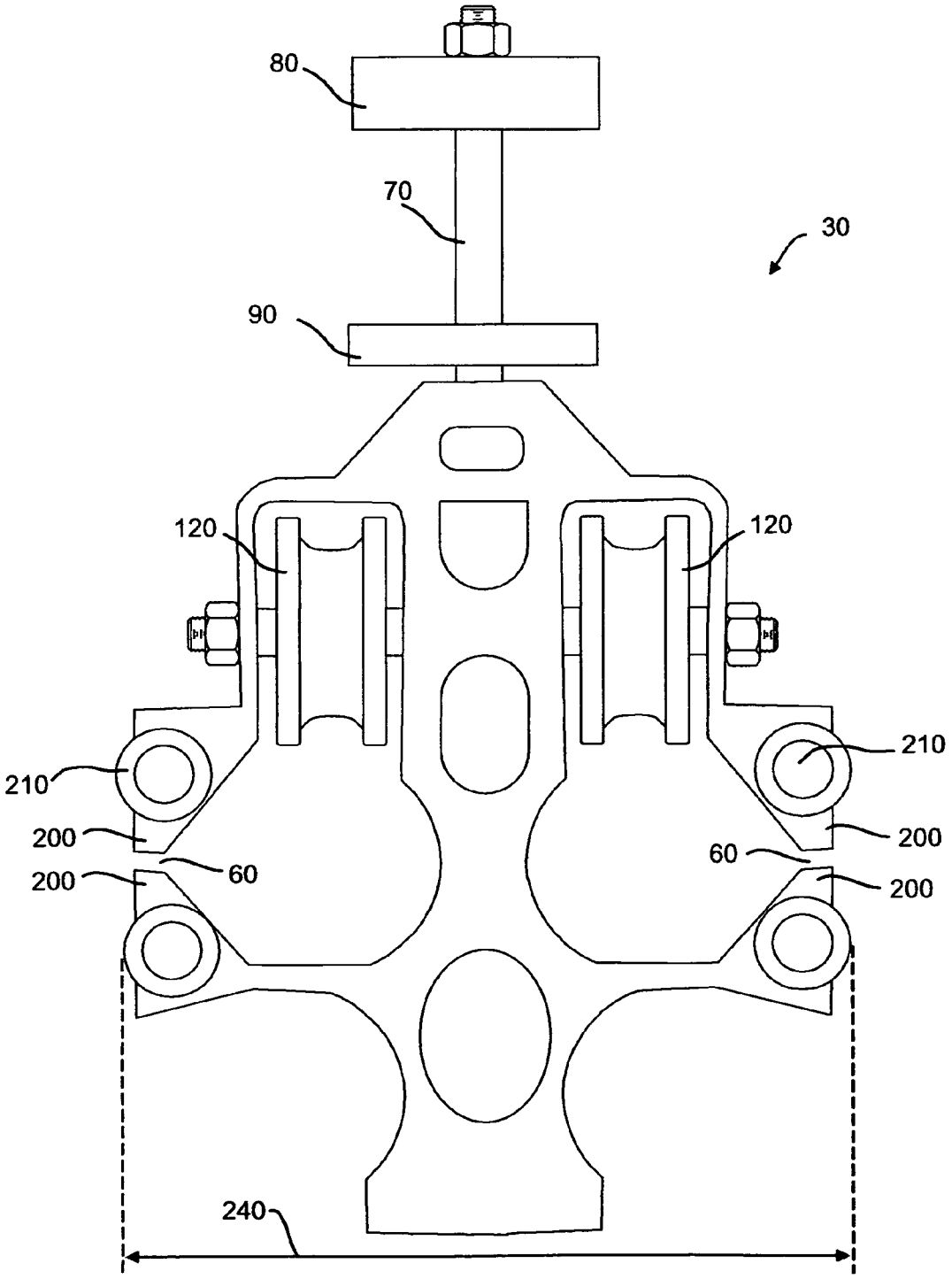
FIG. 3 is a pictorial view of another embodiment of the present invention.

In one embodiment the first member 30 may have at least one pulley or glide 120 that enables the first member 30 to move or displace on the cable 40 or cable track 40. In one embodiment the pulley or glide 120 may be a wheel having a concave surface to receive and retain the cable 40. The wheel 120 may be rotatably disposed on the first member 30 so that the wheel 120 rolls on the cable 40. In another embodiment, the glide 120 may slide along the cable 40 to move the first member 30 with respect to the cable 40. The first member 30 may have a harness connection means 170 to receive a shackle to harness member 110. The first member 30 may have a second member 70 extending upwardly to a puck 80. A top nut 100 may be removably secured to secure the puck 80 on the second member 70. A washer 90 may be slidably disposed on the second member 70, upwardly from the puck 80. Or, as seen in FIG. 3, the washer 90 may be slidably disposed on the second member 70 downwardly from the puck 80.

Figure 2:
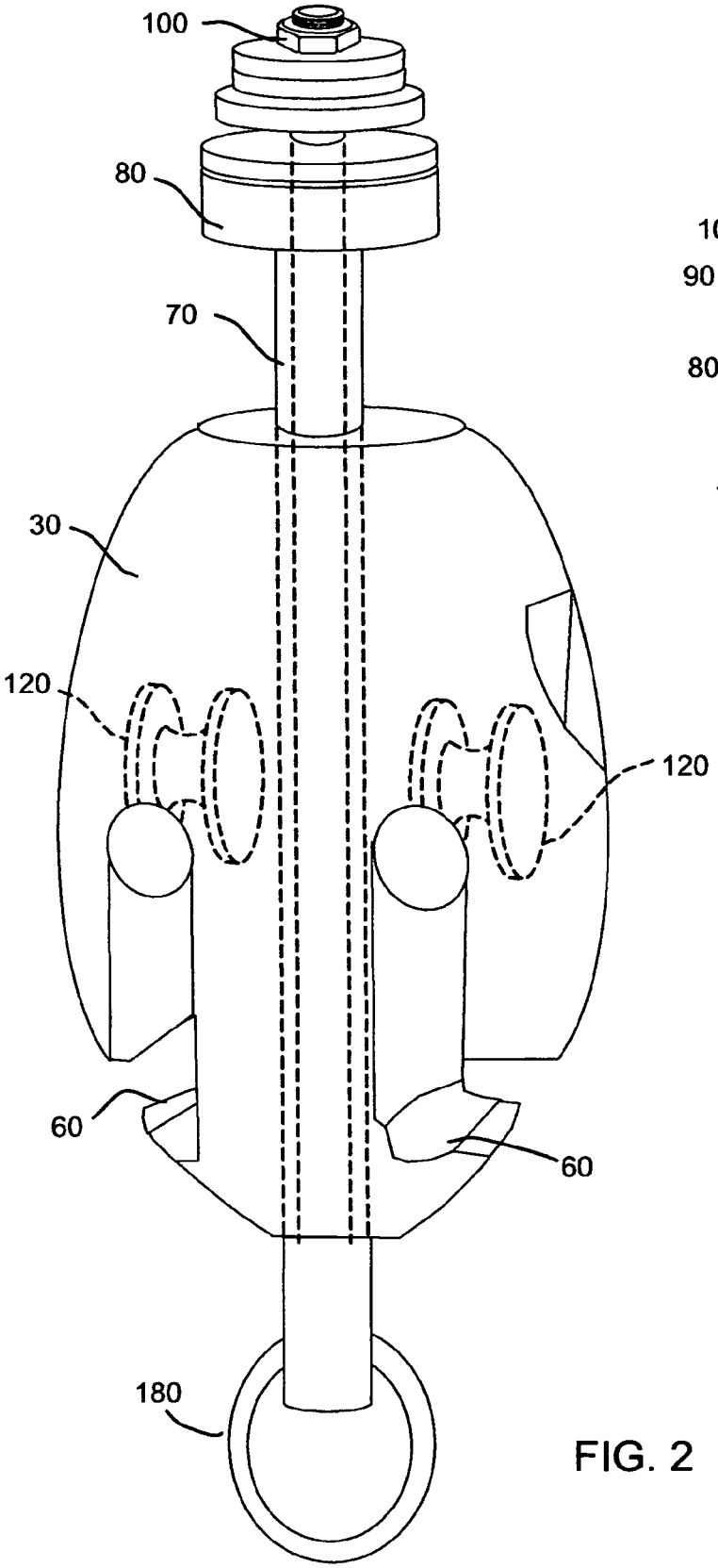
FIG. 2 is a pictorial view of another embodiment of the present invention.

In one embodiment, the second member 70 is hollow to receive a security rope (not illustrated) that extends upward through the top nut 100 to a track (not illustrated), and downward to be connected to an internal member of the first member 30, or an external member such as a harness connection means 170, as illustrated in FIG. 2, so that if the second member 70 breaks, fractures or fails, then the participant (not illustrated) would still be secured to the security rope/safety cable and track, thus preventing the participant from falling.

The cage or transition box 20 may have a housing 220 large enough for the first member 30 to traverse through. The bottom plate 190 may extend inwardly from the housing 220. A clacker gate 260 may be hingedly connected to the housing 240 so as to open in only one direction so as to prevent the first member 30 from going out of the transition box 20 in the wrong direction.

The transition box 20 may have a glide track 140 disposed therein. The puck 80 may slide on the glide track 140, with the second member 70 extending downwardly from the puck 80, and which would be disposed between the glide track 140. In one embodiment the washer 90 may slide on the glide track 140. The glide track 140 may have a glide track opening 160 to separate each of the slide tracks 140. The puck 80 or washer 90 may be able to slide on the upper surface of the glide track 140. The glide track 140 may be used to move the first member 30 about the challenger course without the cable track 40 or the with the cable track 40, which may be disposed below the glide track 140.

The cable track 40 may be disposed within a tube glide 150 that is connected to a bottom plate 190 of the transition box 20. This allows the user to move the first member 30 from the cable track 40 to the tube glide 150 easily, and from the tube glide 150 to the cable track 40 with ease. In one embodiment the tube glide 150 is hollow and the cable track 40 is disposed within the tube glide 150. In another embodiment, the cable track 40 is connected to the tube glide 150. When in the transition box 20, the first member 30 may have to be displaced upwardly so that the puck 80 or washer 90 can be placed upon the tube glide 150, in which case the glide 120 may then be lifted off of the tube glide 150 or the cable track 40.

In operation, the first member 30 would be movably disposed on the cable 40 or cable track 40. The transition box 20 may have a tube glide 150 that is connected to the cable track 40.

The first member 30 may have a first member opening 60. The cable track 40 may have a cable 40 that has a diameter sized so that it cannot traverse through the first member opening 60, to prevent the first member 30 from falling off of the cable 40 or cable track 40. However the opening 60 may be larger than a bottom plate 190 located on the transition box 20. The opening 60 may be defined as the smallest distance between arms 200. That distance being smaller than the diameter of the cable track 40, and being larger than the thickness of the bottom plate 190.

All of the components can be constructed of metal, such as steel. Alternatively, the components can be made of a rigid yet resilient composite. The puck 80 has an external material, or material throughout that slides along the glide track 140 with ease.

The components and method allow the participant to be secured via a shackle to harness 110, as the first member 30 is movably disposed throughout the cable track 40 or cable 40, along the tube glides 150, through the transition box 20, along the glide track 140 to another cable 40 or cable track 40, without the participant disconnecting from the first member 30.

In one embodiment, the glide 120 can rotate along an axis, like a tire rotates around an axle.

In one embodiment the first member 30 may have a radio frequency identification device ("RFID") operably installed therein to locate the location of a particular first member 30 and thus a person connected thereto. This may be useful in large challenge courses where it is possible to get lost.

FIG. 2 illustrates another embodiment of the present invention 10 wherein the first member 30 may be "egg" shaped. This embodiment may have the glide 120 disposed at the upper end of a first member opening 60. As in the embodiment of FIG. 1, the cable track 40 may have a cable 40 that has a diameter sized so that it cannot traverse through the first member opening 60, to prevent the first member 30 from falling off of the cable 40 or cable track 40. However the opening 60 may be larger than a bottom plate 190 located on the transition box 20.

FIG. 3 illustrates an embodiment of the first member 30 of the present invention 10. In this embodiment, there may be two glides 120 rotatably disposed on one axis so that the glides 120 can roll along the cable track 40. In another embodiment the glide 120 may not roll, but slide on the cable track 40.

Two arms 200 may be separated to define a first member opening 60. The arms 200 may have a non-metallic bumper 210 disposed so that the non-metallic bumper 210 extends outwardly from the arm 200 so that the non-metallic bumper 210 may contact any metal inside the transition box 20, to aid in sound reduction and impact reduction. The non-metallic bumper 210 may also prevent the first member 30 from being lifted off of the tube glide 150, by preventing the turning of the first member 30 when the first member 30 in within the transition box 20 because the front-to-rear distance 230 would prevent the turning of the first member 30 if the first member width 240 is nearly the inside width of the inside of the transition box 20. The first member 30 may extend downwardly from the arm 200 to a harness connection means 170.

Figure 4:
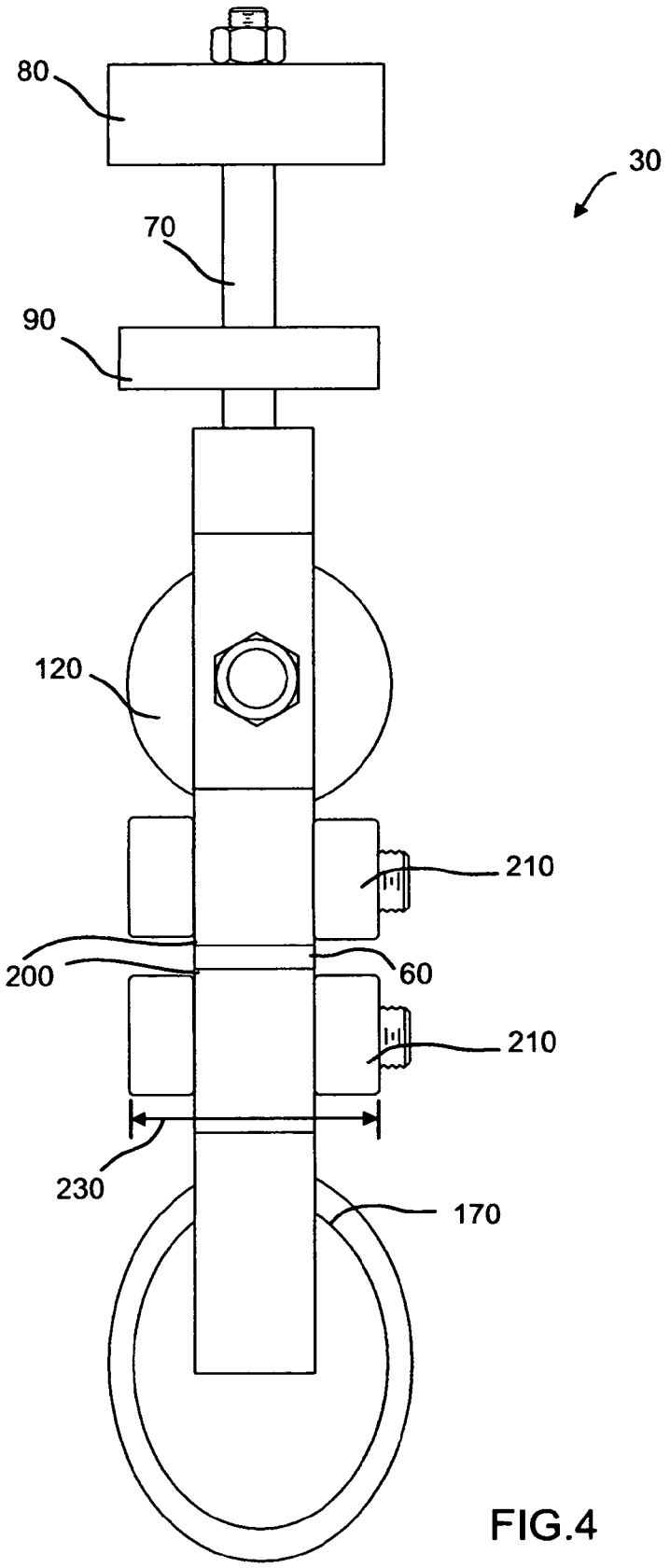
FIG. 4 is a pictorial view of an embodiment of the present invention illustrated in FIG. 3.

FIG. 4 illustrates a side or perspective view of an embodiment of the first member 30 of the present invention 10. The non-metallic bumper 210 may also prevent the first member 30 from being lifted off of the tube glide 150, by preventing the turning of the first member 30 when the first member 30 in within the transition box 20 because the front-to-rear distance 230 would prevent the turning of the first member 30 if the first member width 240 is nearly the inside width of the inside of the transition box 20. The puck 80 is shown disposed upwardly with respect to a washer 90. The glides are illustrated 120 as being concentrically disposed on an axle downwardly from the washer 90. The first member 30 may extend downwardly to a harness connection means 170.

Figure 5:
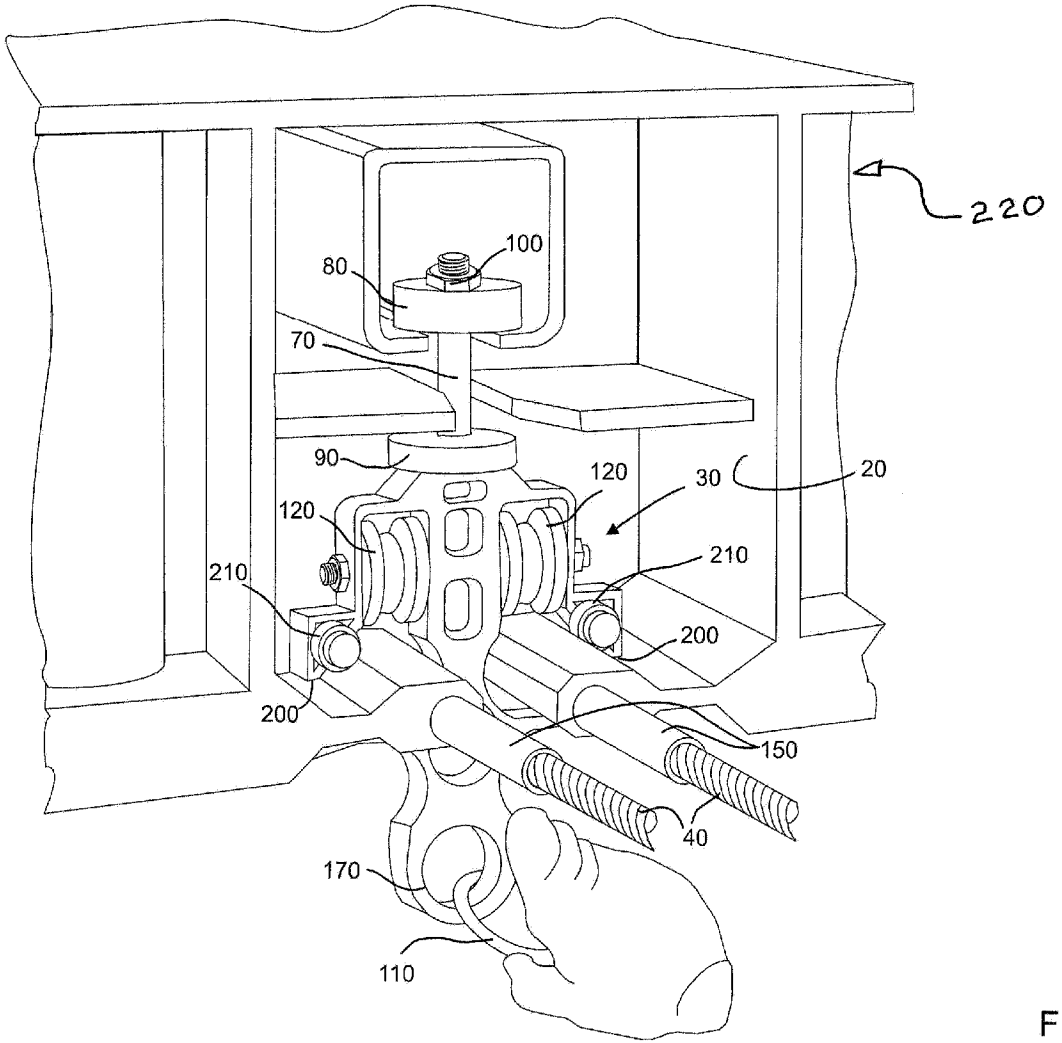
FIG. 5 is a pictorial view of another embodiment of a transition box of the present invention.

FIG. 5 illustrates one embodiment of the transition box or cage 20 of the present invention 10. The cage 20 may have two bottom plates 190 capable of having an opening 60 of a first member 30 to slide around. The cage 20 may have a tube glide 150 that can receive a cable track 40 therein. The tube glide 150 may be cylindrical in shape and hollow so that the cable track 40 can be slid through the hollow portion of the tube glide 150. The cage or transition box 20 may have a housing 220 large enough for the first member 30 to traverse through. The bottom plate 190 may extend inwardly from the housing 220.

Figure 6:
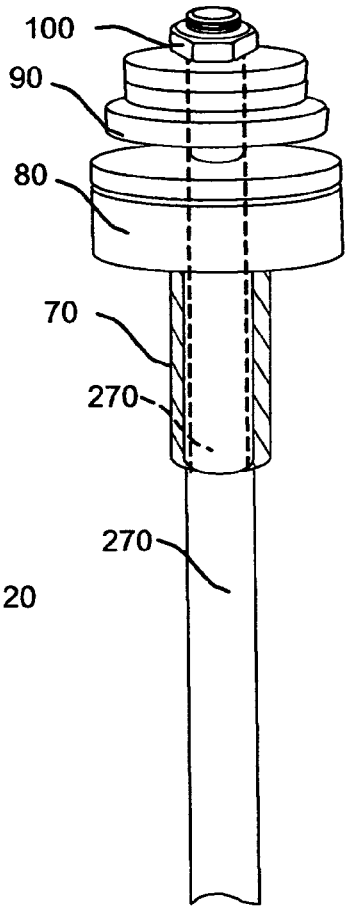
FIG. 6 is a sectional view of the shaft to reveal the secondary retention system Certain terminology will be used in the following description for convenience and reference only, and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the system and designated parts. Said terminology will include the words specifically mentioned, derivatives, and similar words.

FIG. 6 illustrates a secondary retention system 270, which may be a rope connected at the top end to the top nut 100, and at the bottom end to any part of the first member 30. Therefore, if the second member 70 were to break, the secondary retentions system 270 would prevent the first member 30 from separating at the second member 70 and falling downwardly.

Although particular preferred embodiments of the invention have been discussed in detail for illustrative purposes, it will be recognized that variations or modifications of the disclosed apparatus, including the rearrangement of parts, lie within the scope of the present invention.

We claim:

1. A puck-key transition system (10), comprising:

a transition box (20) having a housing (220) capable of having a first member (30) move there through, said housing (220) having a bottom plate (190) extending inwardly therefrom to a tube glide (150);

a cable track (40) disposed through said tube glide (150);

a glide track (140) extending inwardly from said housing (220) upwardly from said tube glide (150); and whereby said first member (30) is in moveable contact with at least one of said tube glide (150) or said cable track (140) by said glide (120) in moveable contact with at least one of either said cable track (40) or said tube glide (150), and said puck (80) is in moveable contact with said glide track (140) when said glide (120) is not in moveable contact with said cable track (40) , and said first member (30) has at least one of either a puck (80) or a washer (90) disposed upwardly from said glide (120), and at least one of either said puck (80) or said washer (90) is in moveable contact with said glide track (140)

a first member opening (160) defined by the space between two said adjacent track glides (140); and said first member (30) having a second member (70) that extends downwardly from at least one of either said puck (80) or said washer (90).

2. The apparatus of claim 1, further comprising:

said first member (30) having two arms (200) on both sides of said first member (30), a distance between said arms (200) define a first member opening (60) on each side of said first member (30), whereby said first member (30) can be moved along a cable track (40) and said first member opening (60) can receive said bottom plate (190) as said first member (30) moves through said transition box (20).

3. The apparatus of claim 1, further comprising:

a secondary retention system (270) connected at one end to a top nut (100), and at a bottom end to another part of said first member (30), said secondary retention system (270) disposed through a secondary member (70).

4. The apparatus of claim 1, further comprising a non-metallic bumper (210) disposed on an arm (200) of said first member (30), said non-metallic bumper (210) extending slightly outwardly from said arm (200), so that as said first member (30) is moving through said transition box (20), said non-metallic bumper (210) can contact said transition box (20) to pre-vent said arm (200) from contacting said transition box (20).

5. The apparatus of claim 1, further comprising a clacker gate (260) that is hingedly connected to said transition box (20) and swings open in one direction so that said first member (30) can move through said clacker gate (260) in only one direction (50).

6. The apparatus of claim 1, wherein said glide (120) comprises two concentric wheels rotatably disposed on an axis, said wheels roll on said cable track (40) and said tube glide (140).

7. A puck-key transition system (10), comprising:

a transition box (20) having a housing (220) capable of having a first member (30) move there through, said housing (220) having a bottom plate (190) extending inwardly there from to a tube glide (150);

a cable track (40) disposed through said tube glide (150);

a glide track (140) extending inwardly from the housing (220) upwardly from said tube glide (150);

whereby said first member (30) has a glide (120) that is in moveable contact with at least one of said tube glide (150) or said cable track (140), and said first member (30) has at least one of either a puck (80) or a washer (90) disposed upwardly from said glide (120), and at least one of either said puck (80) or said washer (90) is in moveable contact with said glide track (140);

a first member opening (160) defined by the space between two of said adjacent track glides (140);

said first member (30) having a second member (70) that extends downwardly from at least one of either said puck (80) or said washer (90);

said first member (30) having two arms (200) on both sides of said first member (30), a distance between said arms (200) define a first member opening (60) on each side of said first member (30), whereby the first member (30) can be moved along a cable track (40) and the opening (60) can receive said bottom plate (190) as the first member (30) moves through the transition box (20);

a secondary retention system (270) connected at one end to a top nut (100), and at a bottom end to another part of the first member (30), said secondary retention system (270) disposed through a secondary member (70);

a non-metallic bumper (210) disposed on an arm (200) of the first member (30), said non-metallic bumper (210) extending slightly outwardly from said arm (200), so that as the first member (30) is moving through said transition box (20), said non-metallic bumper (210) can contact the transition box (20) to prevent the arm (200) from contacting the transition box (20);

a tube glide opening (250) defined by two opposed tube glides (150);

a clacker gate (260) that is hingedly connected to said transition box (20) and swings open in one direction so that the first member (30) can move through the clacker gate (260) in only one direction (50); and a radio frequency identification device (180) secured to said first member (30);

said first member (30) has a width of first member (240) that is about the same as the width of the transition box (20) and a front-to-rear distance (230) so that the first member (30) cannot be removed from the glide tube (150) and fall downwardly from the transition box (20).

* * * * *